United States Patent [19]

Fuller et al.

[11] Patent Number: 4,991,670

[45] Date of Patent: Feb. 12, 1991

[54] ROTARY DRILL BIT FOR USE IN DRILLING HOLES IN SUBSURFACE EARTH FORMATIONS

[75] Inventors: John Fuller, Penzance; Joseph A. Gasan, Stroud, both of England

[73] Assignee: Reed Tool Company, Ltd., Newtownabbey, Northern Ireland

[21] Appl. No.: 433,689

[22] Filed: Nov. 8, 1989

Related U.S. Application Data

[60] Continuation of Ser. No. 187,811, Apr. 29, 1988, Pat. No. 4,889,017, which is a continuation-in-part of Ser. No. 118,604, Nov. 9, 1987, Pat. No. 4,823,892, which is a division of Ser. No. 754,506, Jul. 12, 1985, Pat. No. 4,718,505.

[51] Int. Cl.[5] ..... E21B 10/46

[52] U.S. Cl. ..... 175/329; 175/410

[58] Field of Search ..... 175/329, 330, 409, 410; 76/108 A, 108 R; 419/8, 18; 51/297, 309; 264/60

[56] References Cited

U.S. PATENT DOCUMENTS

| | | | |
|---|---|---|---|
| 2,121,202 | 6/1938 | Killgore | 175/410 |
| 2,495,400 | 1/1950 | Williams, Jr. . | |
| 2,955,810 | 10/1960 | McWhorter et al. . | |
| 3,858,671 | 1/1975 | Kita | 175/410 |
| 3,938,599 | 2/1976 | Horn | 175/329 |
| 4,116,289 | 9/1978 | Feenstra | 175/329 |
| 4,244,432 | 1/1981 | Rowley et al. | 175/329 |
| 4,343,371 | 8/1982 | Baker, III et al. | 175/329 |
| 4,350,215 | 9/1982 | Radtke | 175/329 |
| 4,351,401 | 9/1982 | Fielder | 175/329 |
| 4,460,053 | 7/1984 | Jurgens et al. | 175/329 |
| 4,478,298 | 10/1984 | Hake et al. | 175/329 |
| 4,512,426 | 4/1985 | Bidegaray | 175/329 |
| 4,554,986 | 11/1985 | Jones | 175/397 |
| 4,570,726 | 2/1986 | Hall | 175/410 |
| 4,602,691 | 7/1986 | Weaver | 175/329 |
| 4,604,106 | 8/1986 | Hall | 51/293 |
| 4,624,830 | 11/1986 | Barr | 175/329 |
| 4,667,543 | 5/1987 | Tsugaki et al. | 76/108 A |
| 4,681,174 | 7/1987 | Aubakirov et al. | 175/330 |
| 4,705,124 | 11/1987 | Abrahamson | 175/410 |
| 4,744,427 | 5/1988 | Grappendorf | 175/329 |
| 4,780,274 | 10/1988 | Barr | 175/329 |

FOREIGN PATENT DOCUMENTS

| | | |
|---|---|---|
| 0103820 | 3/1984 | European Pat. Off. . |
| 7715345 | 5/1978 | France . |
| 7615097 | 11/1978 | France . |
| 2504589 | 4/1981 | France . |
| 0679193 | 12/1964 | Italy . |
| 2095724 | 10/1982 | United Kingdom . |

OTHER PUBLICATIONS

"Optimization of Radial Distribution of Stratapax(T1-)Cutters in Rock Drilling Bits", J. D. Barr, 2/1/80; Energy-Sources Technology Conference, New Orleans, 1980, A.S.M.E., Petroleum Division.

(List continued on next page.)

*Primary Examiner*—Ramon S. Britts
*Assistant Examiner*—Terry Lee Melius
*Attorney, Agent, or Firm*—Browning, Bushman, Anderson & Brookhart

[57] ABSTRACT

A rotary drill bit for use in drilling holes in subsurface earth formations comprises a bit body having a shank at one end for connection to a drill string and an operating end face at the other end. A plurality of first cutting structures, each comprising a preform cutting element, is mounted in the bit body at the end face thereof, and each has a superhard front cutting face. The bit body includes a plurality of protuberances projecting outwardly from the adjacent portions of the end face, the protuberances forming a plurality of second cutting structures disposed in generally trailing relation, respectively, to at least some of the first cutting structures. Each of the protuberances is impregnated with superhard particles through a significant depth measured from the outermost extremity of the protuberance. At least a major operative portion of each of the second cutting structures is circumferencially separated from the respective leading first cutting structure by an open space, and is likewise radially separatred from the nearest adjacent second cutting structure or structures.

34 Claims, 5 Drawing Sheets

OTHER PUBLICATIONS

Ad for DIAMAX and SERVICES of 1510 Moudon Switzerland, *World Oil,* Feb. 15, 1982, p. 250–C.

"Developments of Stratapax Blank Drill Bits for Shale Drilling", R. P. Radtke of NL Hycalog, Houston, Tex., 4 pp.

Case History 408, Bits Containing Stratapax Drill Blanks From GE Reduce Cost of Deep Drilling in Austin Chalk Formations, 1 p.

J. K. Smit & Sons Diamond Tools Ltd., Ad, 2 pages, concerning RD5 PXX Soft to Medium Hard Formation Bit, date unknown.

1980–81 Composite Catalog of Oilfield Equipment & Services, vol. 2, Companies D–H, pp. 2138, 2139 and 2317.

1980–81 Composite Catalog of Oilfield Equipment & Services, vol. 3, Companies I–N, p. 5169.

1982–83 Composite Catalog of Oilfield Equipment & Services, vol. 2, Companies C–F, pp. 2430, 2431, 2451, 2452.

FIG. 7
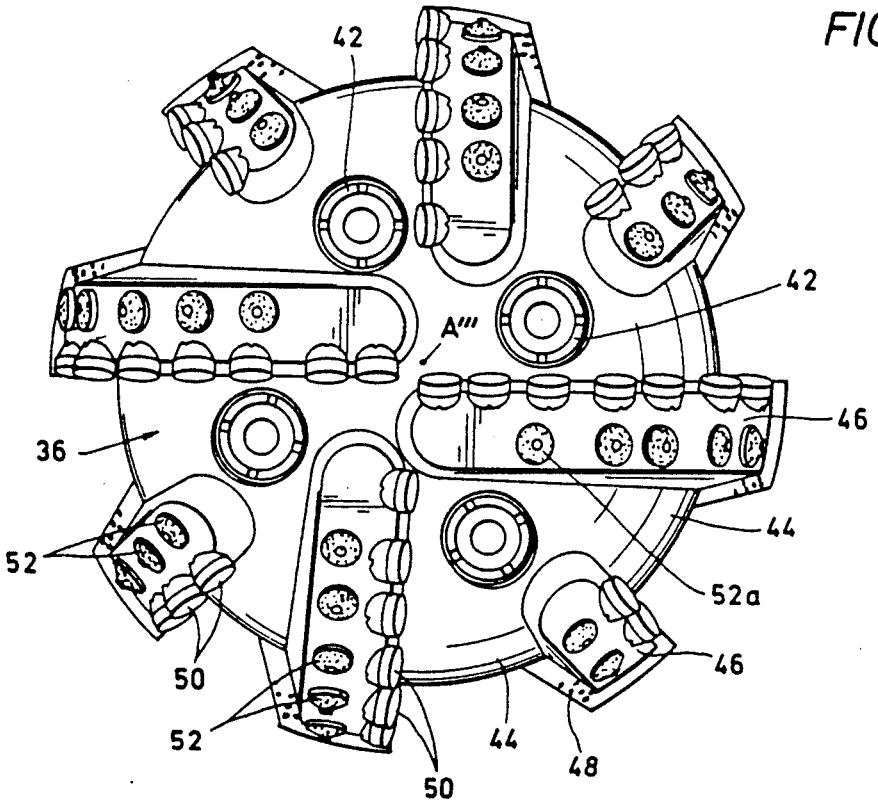
FIG. 9
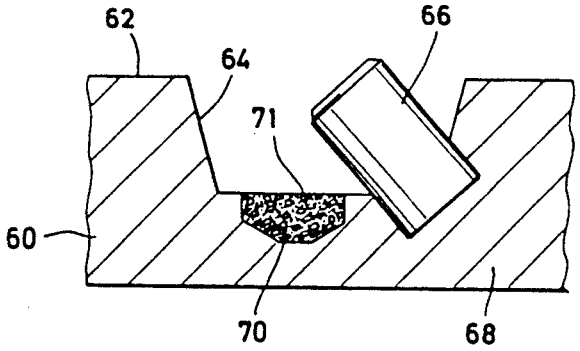
FIG. 8
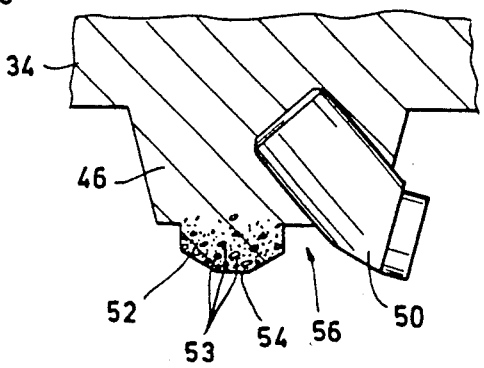
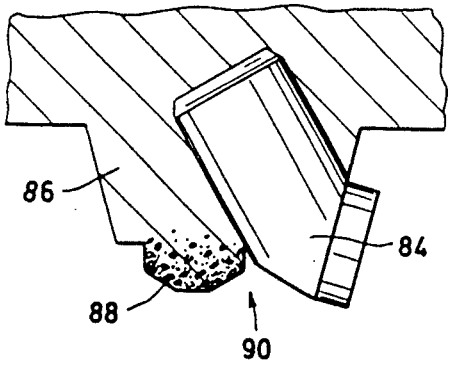
FIG. 10

ROTARY DRILL BIT FOR USE IN DRILLING HOLES IN SUBSURFACE EARTH FORMATIONS

CROSS-REFERENCE TO RELATED APPLICATIONS

This is a continuation of application Ser. No. 187,811, filed Apr. 29, 1988, now U.S. Pat. No. 4,889,017, which is a continuation-in-part of Ser. No. 118,604, filed Nov. 9, 1987, now U.S. Pat. No. 4,823,892, which is a division of Ser. No. 754,506, filed July 12, 1985, now U.S. Pat. No. 4,718,505.

BACKGROUND OF THE INVENTION

The invention relates to rotary drill bits, typically drag bits, for use in drilling holes in subsurface formations. As used herein, "drilling" will include coring as well as the drilling of full bore holes. The bits are of the kind comprising a bit body having a shank at one end for connection to a drill string, an operating end face at the other end, a plurality of cutting elements mounted at the end face, and a passage in the bit body for supplying drilling fluid to the end face for cooling and/or cleaning the cutting elements. At least some of the cutting elements each comprise a preform cutting element having a superhard front cutting face. The invention is particularly, but not exclusively, applicable to drill bits of this kind in which the cutting elements comprise preforms having a thin facing layer of polycrystalline diamond bonded to a backing layer of tungsten carbide Various methods may be used for mounting such preform cutting elements on the bit body but such methods, and the general construction of bits of the kind to which the invention relates, are well known and will not therefore be described in detail.

When drilling deep holes in subsurface formations, it often occurs that the drill passes through a comparatively soft formation and strikes a significantly harder formation. Also there may be hard occlusions within a generally soft formation. When a bit using preform cutters meets such a hard formation the cutting elements may be subjected to very rapid wear.

In order to overcome this problem it has been proposed to provide, immediately adjacent the rearward side of at least certain of the cutting elements, a body of material impregnated with natural diamond. For example, in the case where the bit body is a matrix material formed by a powder metallurgy process, it is known to mount each cutting element on a hard support which has been cast or bonded into the material of the bit body and in one such arrangement the hard support has been impregnated with diamond.

With such an arrangement, during normal operation of the drill bit the major portion of the cutting or abrading action of the bit is performed by the cutting elements in the normal manner. However, should a cutting element wear rapidly or fracture, so as to be rendered ineffective, for example by striking hard formation, the diamond-impregnated support on which the element is mounted takes over the abrading action of the cutting element thus permitting continued use of the drill bit. Provided the cutting element has not fractured or failed completely, it may resume some cutting or abrading action when the drill bit passes once more into softer formation.

A serious disadvantage of such an arrangement is that abrasion of the diamond-impregnated support against the formation generates a great deal of heat and the resultant high temperature to which the adjacent cutting element is subjected tends to cause rapid deterioration and failure of the cutting element and/or its attachment to the support. The present invention therefore sets out to provide arrangements in which this disadvantage is reduced or overcome.

In other bits, surface set natural diamonds are mounted in the bit body in trailing relation to the preform cutting elements. However, once such a surface set diamond is lost, e.g. due to wear of the surrounding area of the bit body, any advantage thereof is likewise lost.

SUMMARY OF THE INVENTION

According to one aspect of the invention, there are spaced from at least certain of said cutting elements, with respect to the normal direction of rotation of the bit, an abrasion element comprising particles of superhard material, such as natural or synthetic diamond, embedded in a carrier element mounted on the bit body. Preferably each abrasion element is spaced rearwardly of its associated cutting element, with respect to the normal direction of rotation.

The abrasion elements may be so positioned with respect to the leading surface of the drill bit that they do not come into cutting or abrading contact with the formation until a certain level of wear of the cutting elements is reached.

Preform cutting elements are susceptible to greater wear and risk of failure as their temperature rises, and by spacing the abrasion elements from the cutting elements overheating of the cutting elements and/or their attachments to the bit body, due to engagement of the abrasion elements with the formation, may be kept to a minimum. A waterway for drilling fluid may be provided in the surface of the drill bit between the cutting elements and abrasion elements to minimize transfer of heat to the cutting elements.

The preform cutting elements may each comprise a thin hard facing layer of superhard material, such as polycrystalline diamond, bonded to a less hard backing layer, e.g. tungsten carbide, so that the preform cutting element is self-sharpening. The backing layer may be, or may be mounted on, a carrier, such as a stud, which is received in a socket in the bit body. Alternatively, each preform cutting element may comprise a preform unitary layer of thermally stable polycrystalline diamond material which may be mounted directly in the bit body, or mounted via a carrier.

In accord with another aspect of the invention, if the preform cutting elements are considered the "first" cutting structures of the bit, it has been found that a plurality of "second" cutting structures or abrasion elements can, at least in matrix-type bits, be integrally formed as part of the bit body itself This not only simplifies production, but also virtually eliminates the possibility of total loss of one or more of the second cutting structures during drilling.

More specifically, the bit body includes a plurality of protuberances projecting outwardly from the adjacent portions of the end face, those protuberances forming a plurality of second cutting structures disposed in generally trailing relation, respectively, to at least some of the first (preform) cutting structures. Each of the protuberances is impregnated with a plurality of particles of superhard material, preferably natural diamond. These particles extend through a significant depth of the protuberance, measured from its outermost extremity, so that even if some wear does occur, and some of the particles nearest the surface of the protuberance are lost, the protuberance will still continue to operate effectively as an abrasion type cutting structure as deeper particles are exposed and take over the action.

It is now believed that, in use of a bit including both preform cutting structures and abrasion-type cutting structures, one of the advantages is that the second or abrasion-type cutting structures take a good part of the heat generated during drilling, and which would otherwise be taken by, and detrimental to, the preform cutters. Thus, in preferred embodiments of the present invention, each of the second cutting structures is circumferentially separated from its respective leading first cutting structure by an open space, even if the tWo are disposed on the same blade of the drill bit.

Furthermore, whereas in prior patent No. 4,512,426 to Bidegaray, it is suggested that it is desirable that either one or the other of two sets of cutting structures be primarily operative at any given time, the other set being held away from or embedded into the formation, depending on its nature, the present inventors have found that, even when the first (preform) cutting structures are operating on the formation, it is desirable that the second cutting structures also contact the formation so that excessive friction heat generation by the first cutting structure is prevented. On the other hand, with the possible exception of certain rather unusual drilling conditions, it would not appear to be desirable, as suggested by Bidegaray, to have the second hard rock cutting structures protruding by a greater distance than the preform cutting structure.

Accordingly, in preferred embodiments, the second cutting structures protrude from the end face of the bit body by distances less than or equal to those for their respective leading first cutting structures. In that way, both types of cutting structures will contact the earth formation, either initially (when their protruding distances are initially equal) or after a small amount of wear of the first cutting structures (when the first cutting structures initially protrude by a slightly greater amount). On the other hand, the second cutting structures will neither hold the first cutting structures away from a formation which they should be cutting nor imbed into the formation, thereby causing unnecessary friction and heat generation. Nevertheless, if a hard occlusion is encountered, the second cutting structures, protruding by approximately the same distance as the first cutting structures, will still limit the amount of wear which can occur on the first cutting structures. In the most highly preferred embodiments, it is preferred that, if the first cutting structures initially protrude more than the second cutting structures, the difference in protrusion should be no more than about 1 mm.

In typical embodiments of the present invention, the first cutting structures are arranged in rows progressing generally radially along the end face of the bit body, typically each row being carried on a respective blade of the bit body. The second cutting structures are likewise arranged in similar rows. It is preferred that at least most of the second cutting structures be in directly trailing relation to its respective first cutting structure, i.e. located at approximately the same radial distance from the axis of the bit.

Futhermore, since the first cutting structures in a given row are typically spaced apart radially, it is preferred that the second cutting structures likewise be radially separated by open spaces. One of the advantages of this is that the second cutting structures are thereby prevented from working the gaps between the first cutting structures, whereby they may have to become unduly deeply embedded in the earth formation and thereby generate excessive heat or other problems, but rather the second cutting structures provide a precise backup for their respective first cutting structures. This system works particularly well when each pair of rows of first and second cutting structures are disposed on a respective blade of the bit body, and wherein the cutting structures on adjacent or successive blades are radially staggered.

Also, when the second cutting structures are radially separated from each other by open spaces and circumferentially separated from the first cutting structures by more open spaces, maximum cooling of the second cutting structures by the drilling fluid is permitted, thus even further reducing the possibility of heat transfer to the preform cutting elements or thermal damage to the protuberances.

The invention further comprises a method for making bits of the type last described. A plurality of discrete quantities of spacer material, such as tungsten carbide powder, each having a plurality of superhard particles dispersed therein through a significant depth, are placed in recesses in a mold for the bit body. Then, in a more or less conventional manner, a matrix-type bit body or a portion thereof is formed in the mold onto, into, and/or around the quantity of spacer material. The preform cutting structures can be mounted in the bit body thereafter in any conventional manner.

In some instances, the infiltrant which is used to form the matrix of the bit body being molded infiltrates the quantities of spacer material as well, either flowing into interstices originally in the spacer material, or replacing a volatile temporary binder, so that, in the finished bit body, the protuberances formed by the quantities of spacer material and diamonds are monolithically continuous with the matrix of the bit body. Likewise, if the quantity of spacer material and diamonds is itself a tungsten carbide matrix with an infiltrant which is amalgamable with that to be used in forming the matrix of the bit body, and if, in forming the latter matrix, the mold is heated to a temperature greater than or equal to the melting points of both infiltrants, then the protrusions likewise become monolithically continuous with the matrix of the bit body.

However, even if such monolithic integration is not literally possible, e.g. if the quantity of spacer material is a slug of hot pressed tungsten carbide with a permanent binder whose melting point is higher than that to which the mold is to be heated, the bit matrix can still be formed against, and indeed in surrounding relation to an inboard end of such a slug. In the resulting bit, the slug of material and the protruberance formed thereby will still be an integral part of the bit body in the sense of this application, i.e. in that they cannot be separated from the remainder of the bit body without destroying one or the other or both.

Accordingly, it is a principal object of the present invention to provide an improved "hybrid" type bit, comprising both preform cutting structures and abrasion type cutting structures, the latter being integrally formed as part of the bit body, and including superhard particles extending through a significant depth thereof.

Another object of the present invention is to provide such a bit in which each such abrasion type cutting structure is circumferentially separated from a respective leading preform cutting structure by an open space.

A further object of the present invention is to provide such a bit in which at least some of the abrasion type cutting structures are arranged in rows progressing generally radially along the end face of the bit, radially spaced from each other and directly trailing their respective preform cutting structures.

Another object of the present invention is to provide such a bit in which each of the abrasion type cutting structures protrudes from the bit body by a distance less than or equal to the analogous distance for its respective preform cutting structure.

Still another object of the present invention is to provide a method for making such a bit.

Other objects, features, and advantages of the present invention will be made apparent by the following detailed description, the drawings, and the claims.

BRIEF DESCRIPTION OF THE DRAWINGS

FIG. 7 is an end elevation view of the bit of FIG. 6.

FIG. 8 is a detailed cross-sectional through a respective pair of cutting structures of the bit of FIGS. 6 and 7.

FIG. 9 is a detailed cross-sectional view through a mold whereby the structure of FIG. 8 can be formed.

FIG. 10 is a view similar to FIG. 8 showing an alternate embodiment.

DETAILED DESCRIPTION

Figure 1:
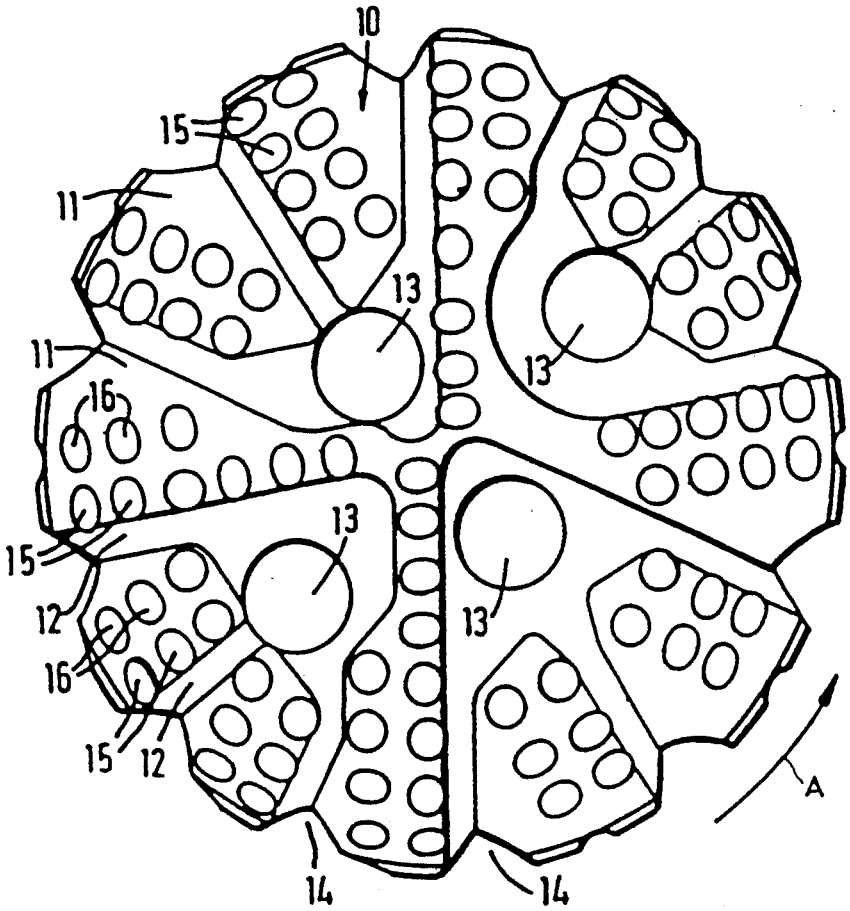
FIGS. 1 and 2 are bottom end views of rotary drill bits according to the invention.

The rotary bit body of FIG. 1 has an operating end face 10 formed with a plurality of blades 11 upstanding from the surface of the bit body so as to define between the blades inset channels or watercourses 12 for drilling fluid. The channels 12 lead outwardly from nozzles 13 to which drilling fluid passes through a passage (not shown) within the bit body. Drilling fluid flowing outwardly along the channels 12 passes to junk slots 14 in the gauge portion of the bit.

Mounted on each blade 11 is a row of first cutting structures in the form of cutting elements 15. The cutting elements project into the adjacent channel 12 so as to be cooled and cleaned by drilling fluid flowing outwardly along the channel from the nozzles 13 to the junk slots 14. Spaced rearwardly of the three or four outermost cutting elements on each blade are second cutting structures in the form of abrasion elements 16. As used herein, the terms "forward" and "rearward" refer to the intended direction of rotation of the bit in use, indicated by the arrow A in FIG. 1. Accordingly, each of the elements 16 will be said to be in generally trailing relation to the cutting element 15 forward of it on the same blade. Conversely, that same cutting element 15 will be the respective leading cutting element with respect to the abrasion element 16 behind it on the same blade. In the arrangement shown each abrasion element lies at substantially the same radial distance from the axis of rotation of the bit as its associated cutting element, so that it is in "directly trailing" relation thereto, although other configurations are possible.

Figure 2:
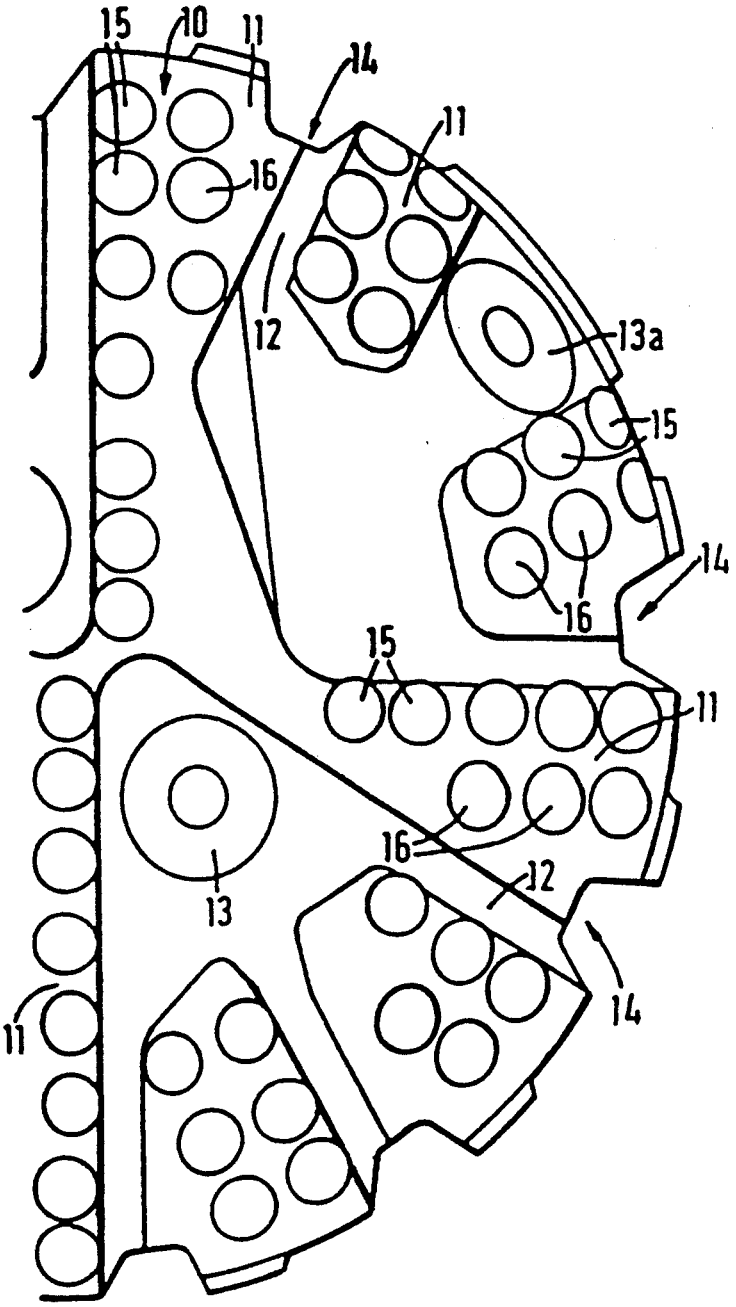

FIG. 2 shows an alternative and preferred arrangement in which some of the nozzles are located adjacent the gauge region of the drill bit, as indicated at 13*a* in FIG. 2. The flow from such a peripheral nozzle passes tangentially peripheral portions of the leading face of the bit to the junk slots 14, thus ensuring a rapid and turbulent flow of drilling fluid over the intervening abrasion and cutting elements so as to cool and clean them with efficiency.

Figure 3:
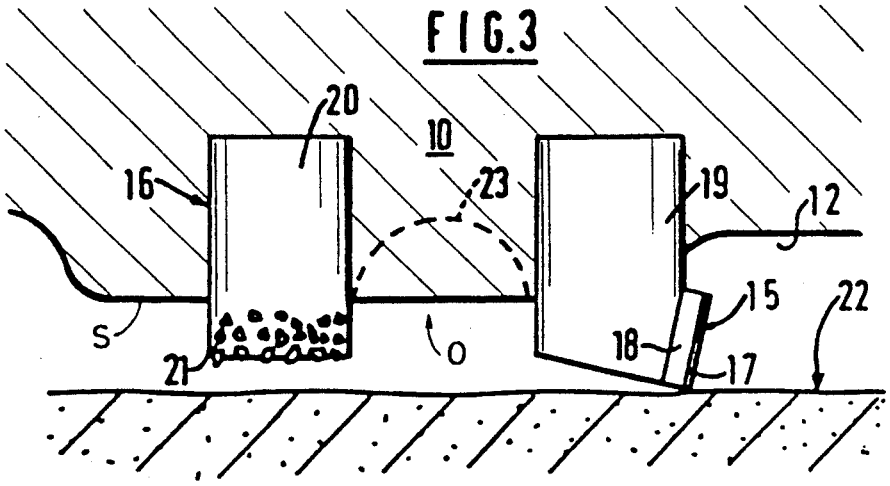
FIG. 3 is a diagrammatic section through a cutting element and associated abrasion element.

In either of the arrangements described, the cutting elements 15 and abrasion elements 16 may be of many different forms, but FIG. 3 shows, by way of example, one particular configuration.

Referring to FIG. 3, it will be seen that each cutting element 15 is a circular preform comprising a front thin hard facing layer 17 of polycrystalline diamond bonded to a thicker backing layer 18 of less hard material, such as tungsten carbide. The cutting element 15 is bonded, in known manner, to an inclined surface on a generally cylindrical stud 19 which is received in a socket in the bit body 10. The stud 19 may be formed from cemented tungsten carbide and the bit body 10 may be formed from steel or from matrix material.

Each abrasion element 16 also comprises a generally cylindrical stud 20 which is received in a socket in the bit body 10 spaced rearwardly of the stud 19. The stud 20 may be formed from cemented tungsten carbide impregnated with particles 21 of natural or synthetic diamond or other superhard material As used herein, "superhard" will mean materials significantly harder than silicon carbide, which has a Knoop hardness of 2470, i.e. to materials having a Knoop hardness greater than or equal to 2500. The superhard material may be embedded in only the surface portion of the stud 20, but is preferably impregnated throughout a significant depth of the stud 20, measured from its outermost extremity. Using diamond particles in the preferred size range of about 30 to 40 stones per carat, this depth would ordinarily be at least about 2 mm, although a depth of at least 4 mm would be preferable in most instances, while in certain instances it might even be possible to have a depth of less than 2 mm. The most important point is that the depth through which the particles extend should be significantly greater than the size of the individual particles. Thus, if, e.g. due to some wear, some of the outermost diamond particles are lost in use, their role will be taken up by still deeper diamond particles.

Figure 4:
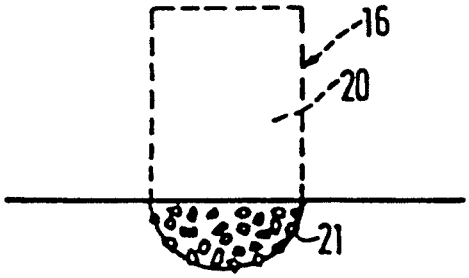
FIG. 4 is a view of an abrasion element.

Referring to FIG. 4, it will be seen that each abrasion element 16 may have a leading face which is generally part-circular in shape.

The abrasion element 16 may project from the surface of the bit body 10 to a similar extent to the cutting element, or, as shown, the cutting element may project outwardly slightly farther than its associated abrasion element, preferably by no more than 1 mm. Thus, initially before any significant wear of the cutting element has occurred, only the cutting element 15 engages the formation 22, and the abrasion element 16 will only engage and abrade the formation 22 when the cutting element has worn beyond a certain level, or has failed through fracture. In the arrangement shown, wherein the elements 15 and 16 are disposed on a common blade of the bit body, and wherein that blade has an outer surface which, with the possible exception of a fluid channel 23, generally parallels the profile of the formation to be out, it is convenient to think in terms of measuring the distance of protrusion from that outer surface S. However, a more accurate way to compare the degree of protrusion of the cutting elements and abrasion elements, respectively, and one which allows for application to unusual bit body designs, is to state that, if the bit is rotated about its own axis, the outer extremities of the cutting elements 15 will define a domelike surface of revolution. Then, it can be stated that the abrasion elements should lie on or within that surface of revolution, and if spaced therefrom, preferably by a distance of no more than 1 mm.

In the arrangement shown, the stud 20 of the abrasion element is substantially at right angles to the surface of the formation 22, but operation in softer formations may be enhanced by inclining the axis of the stud 20 forwardly or by inclining the outer surface of the abrasion element away from the formation in the direction of rotation.

In order to improve the cooling of the cutting elements and abrasion elements, further channels for drilling fluid may be provided between the two rows of elements as indicated at 23 in FIG. 3.

The abrasion elements 16 are spaced from the respective leading cutting elements 15, more specifically circumferentially separated by open space 0, to minimize heat transfer from the abrasion element to the cutting element.

Any known form of cutting element 15 may be employed and the invention includes in its scope arrangements where the cutting element is mounted directly on the bit body, or on another form of support in the bit body, rather than on a cylindrical stud such as 19.

Figure 5:
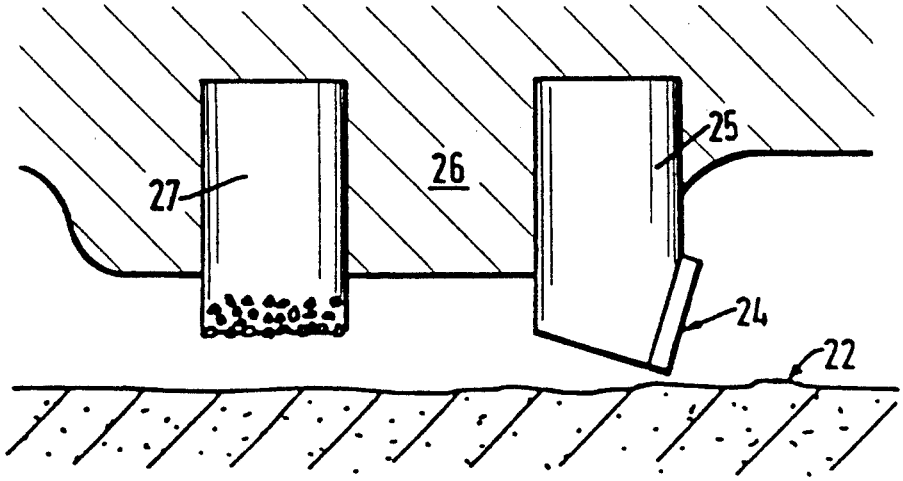
FIG. 5 is a similar view to FIG. 3 of an alternative arrangement.

FIG. 5 shows an arrangement where the cutting element 24 is in the form of a unitary layer of thermally stable polycrystalline diamond material bonded without a backing layer to the surface of a stud 25, for example of cemented tungsten carbide, which is received in a socket in a bit body 26 which in this case is formed from steel. In accordance with the present invention, an abrasion element 27 is spaced rearwardly of each cutting element 24.

Figure 6:
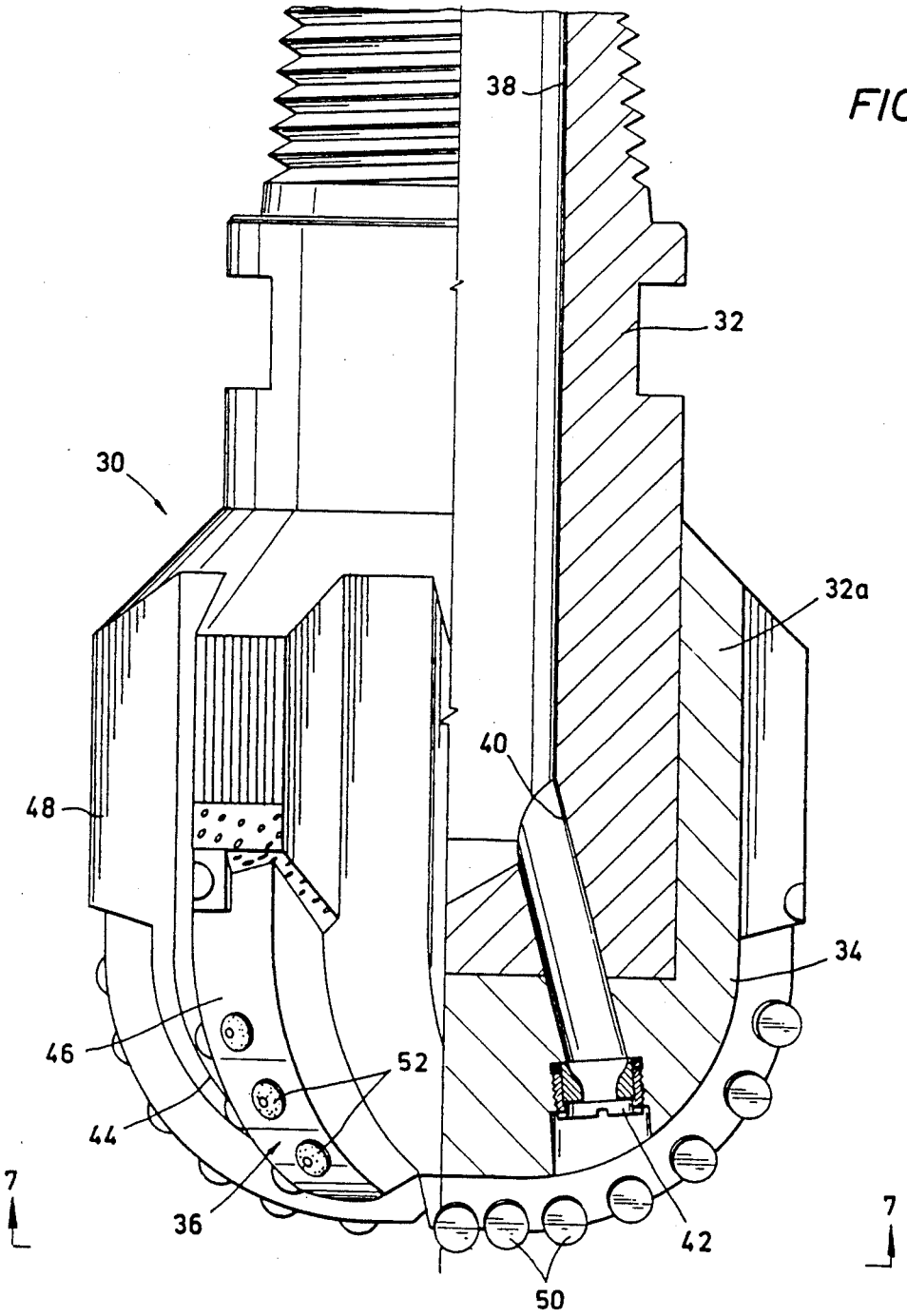
FIG. 6 is a longitudinal quarter-sectional view of a drill bit according to the present invention in which the abrasion elements are part of the bit body.

Referring now to FIGS. 6 and 7, there is shown a drag type drill bit 30 according to another embodiment of the present invention Although the shank 32, which is adapted for connection to a drill string, may be steel, and may include a hub like extension into the interior of the bit (diagrammatically shown at 32*a*), the outer operative portion 34 of the bit body, which generally defines the operating end face 36, is formed of a tungsten carbide matrix. As used herein, "end face" will mean the entire complex surface of the operating end of the bit, including both the upstanding blades 46 and the intervening water courses 44, exclusive of the cutting elements and abrasion elements, to be described hereinafter. Also, in this application, "tungsten carbide matrix" or more simply "matrix" will be used in the manner typical of the drag bit industry, and not in the strict metalurgical sense. Thus, when a charge of tunsten carbide powder is infiltrated with a binder such as a nickel brass alloy, the entire resulting structure, and not necessarily just the continuous phase or alloy, will be considered a matrix. Furthermore, unless otherwise specifically stated, hot pressed sintered and/or cemented tungsten carbide bodies, with binders such as cobalt whose melting points are dangerously close to the temperatures at which diamond materials can be damaged, will not be considered matrix materials, although they might be matrixes in the strict metalurgical sense.

The bit body has a central bore 38 extending into the upper end of the shank 32 and communicating with internal passageways 40 leading to nozzles 42 mounted at the operating end face 36. Drilling fluid is pumped through the nozzles 42 in use and thence through the channels or water courses 44 which are interspersed with the blades 46 upstanding from the operating end face 36 of the bit. Kickers 48, continuous with the blades 46, extend up along the gauge region of the bit body and serve to stabilize the bit in the borehole. They may be provided with diamonds, tungsten carbide buttons, or other wear resistant means on their outer surfaces.

As best seen in FIG. 7, the blades 46 extend generally outwardly from the axis A''' of the bit, i.e. generally radially along the operating end face 36. At the leading face of each blade 46, facing into the adjacent channel 44, is a row of first cutting structure in the form of preform cutting elements 50, progressing along the length of the blade and radially spaced apart from each other. Behind at least some of the cutting elements 50 in each such row, are respective trailing second cutting structures or abrasion elements 52. However, whereas in the preceding embodiments, the abrasion elements were preformed and mounted in a completed bit body after manufacture of the latter, the matrix portion 34 of the bit 30 is actually formed onto, into, and/or around the structures 52, so that structures 52 actually become integral parts of the bit body, more specifically, protuberances extending outwardly from the adjacent portions of the operating end face 36.

It can be seen that, just as the cutting elements 50 are radially spaced from each other along the various rows, the elements 52 in a given row are likewise radially spaced from each other. Most of these elements 52 are in directly trailing relation to their respective leading cutting elements 50, i.e. they lie at approximately the same radial distance from the axis A''' of the bit. Even those such as element 52*a* which are not precisely directly trailing, at least overlap the paths of their respective leading cutting elements. This prevents the abrasion elements from working exclusively in the gaps between the cutting elements in the adjacent leading row. Thus, they provide more or less direct backups for their respective leading cutting elements and are preventing from embedding too deeply into uncut portions of the earth formation.

Turning now to FIG. 8, it can be seen that the protuberance 52 which forms the abrasion element is formed of a tungsten carbide matrix monolithically continuous with that of portion 34 of the bit body. However, protruberance 52 is impregnated with a plurality of particles 53 of superhard material, such as natural diamond, not only at the surface, but through a significant depth measured from its outermost extremity 54. Thus, unlike a surface set diamond, which once lost, has no backup, if the protruberance 52 wears, and diamond particles near the surface are lost, their abrasion and wear resistance function will be taken up by additional particles deeper within the protuberance 52. This ability to accommodate wear and have new and different diamond particles at different levels to replace those which are lost is what is meant herein by a "significant" depth.

FIG. 8 also shows that the protuberance 52 is circumferentially spaced or separated from its respective leading cutting element 50 by an open space 56. It is now believed that a major advantage of the use of hybrid bits having both preform cutting structures and abrasion elements is that the abrasion elements take up a good part of the heat which would otherwise be taken by the preform cutting elements. The separation 56 helps to prevent this heat from being transfered to the cutting element 50, and that effect is further enhanced by the fact that the space 56 allows for circulation of drilling fluid therein, which further serves to cool the structures. It can be seen that this cooling effect is likewise enhanced by the radial separation between adjacent protruberances 52 on a given row.

Indeed, although the protuberances 52 are actually part of the matrix portion of the bit body, their configuration is similar to that of a free end of one of the stud-like abrasion elements 16 of the preceding embodiments they protrude freely from the adjacent portions of the bit body about their entire circumference, rather than being back supported or blended into the profile of the blade, and this maximizes the opportunity for heat transfer to the drilling fluid.

FIG. 9 shows a detailed portion of a mold 60 in which the structure of FIG. 8 can be formed. As is well known in the art, the mold 60 will have an interior surface 62 which defines the general configuration of the operating end face of the matrix portion of the bit body. Thus, for example, it will have elongate recesses 64 corresponding to and forming the upset blades 46 of the finished bit. A former 66 whose configuration is similar to that of one of the cutting elements 50 is placed in a hole 68 in the mold 60 so that it protrudes into the mold cavity. Thus, as matrix is formed around it, it will form a hole in the matrix into which a cutting element 50 can later be installed. In trailing relation to the former 66, the inner surface of the mold 60 has a recess 70 defining the configuration of one of the protuberances 52.

In one preferred method of forming a bit according to the present invention, a so called "wet mix" 71 is placed in the recess 70. Similar quantities of wet mix are placed in each mold recess which corresponds to one of the protuberances 52. The wet mix 71 includes a quantity of a spacer material, preferably tungsten carbide powder, with a plurality of diamond or other superhard particles dispersed therethrough. A temporary binder, preferably a volatile substance such as polyethylene glycol, holds the tungsten carbide powder and diamonds together in a formable mass which can be handled and pressed into the recess 70, hence the term "wet mix."

After the wet mix has been placed in the various recesses such as 70, formation of the bit body proceeds in a more or less conventional manner. Specifically, the steel shank 32 is supported in its proper position in the mold cavity along with any other necessary formers, e.g. for holes to receive nozzles 42. The remainder of the cavity is filled with a charge of tunsten carbide powder. Finally, a binder, and more specifically an infiltrant, typically a nickel brass alloy, is placed on top of the charge of powder. The mold is then heated to at least the melting point of the infiltrant, the infiltrant in turn being chosen so that its melting point is lower than the temperatures at which damage to diamond typically occurs. However, at these temperatures, the temporary binder in the wet mix will gas off, so that the infiltrant will not only infiltrate the charge of tungsten carbide powder forming the major part of the bit body, but will also infiltrate the spaces evacuated by the temporary binder. Thus, the tungsten carbide in the recess 70 as well as the remainder of the mold cavity is essentially formed into a continuously monolithic matrix. Later, the cutting elements 50 can be mounted in the holes provided therefore in any conventional manner.

In other methods, the quantity of spacer material placed in the recess 70 could be in the form of a solid self supporting body, rather than in a flowable or malleable wet mix. For example, that body could be a solid slug comprising tungsten carbide with diamond particles dispersed therethrough. If so, the slug might be larger than the recess 70, and might have an end portion which protrudes into the mold cavity.

For example, such a slug might be formed of cold pressed tungsten carbide powder, so that it would be self supporting, but would have a network of interstices. Then, when the mold is heated, the infiltrant for the main body of the matrix would also enter and infiltrate the interstices, once again forming a continuously monolithic body of the protuberances 52 and adjacent portions of the bit body matrix 34.

In other instances, the slug of material at least one end of which is placed in the recess 70 could itself be formed of a tungsten carbide matrix, already infiltrated with an alloy similar to that to be used in forming the bit body. In this case, when the mold is heated, the infiltrant within the protruberances would reliquify and amalgamate with the infiltrant flowing down through the main charge of tungsten carbide powder, and once again a monolithically continuous matrix body would be formed.

Figure 11:
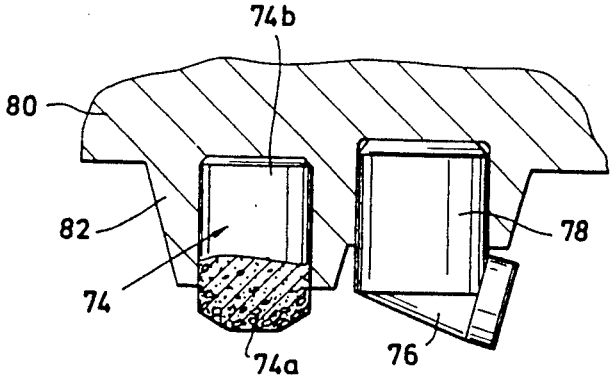
FIG. 11 is a view similar to that of FIGS. 8 and 10 showing and alternative embodiment.

FIG. 11 illustrates still another possibility. The variation of FIG. 11 would have been formed by placing in each recess 70 one end of a stud like body 74 of hot pressed tungsten carbide. Such a body would have a permanent binder, such as cobalt, whose melting point is above that to be used in forming the bit body matrix. The end 74*a* which would be placed in the recess 70 would be impregnated with diamond particles and the other end 74*b* would extend into the mold cavity. To allow this, instead of an angled cutter 50, the cutter 76, and its corresponding mold former, would have a post 78 extending perpendicular to the bit profile. The member 74 could be unfinished, i.e. would not have to be machined to any particularly close tolerance.

The bit body matrix 80, including the blade 82, would then be formed, as previously described, on and around the inward end 74*b* of member 74. The binder in the member 74 would not reliquify. However, with the matrix 80 being formed on and about the member 74, that member would become an integral part of the finished bit body in the sense that it could not be separated therefrom without destruction of the member 74, the bit body, or both.

FIG. 10 shows a variation in which the cutting element 84 has a larger post, and in order to fit on the same blade 86 as the abrasion protuberance 88, the base or innermost part of protuberance 88 must be virtually contiguous the cutting element 84. Nevertheless, it can be said that at least the major operative portions of the protuberance 88 and cutting element 84 are circumferentially separated by the open space 90. In most instances, this will allow for adequate heat isolation, for if the elements 84 and 88 should become worn to the point that they were attempting to operate on the portions thereof which are contiguous, then they would have, for practical purposes, been worn to the point that they would be considered "lost" by those versed in the art.

Numerous modifications of the foregoing exemplary embodiments will suggest themselves to those of skill in the art. By way of example only, in the example shown the entire lower portion 34 of the bit body is formed of tungsten carbide matrix, so that this matrix defines the entire end face 36 of the bit body. In other designs, however, the extension 32*a* of the steel shank 32 could extend downwardly and outwardly so that it would define the water courses 44, with matrix forming only the blades 46. It can be seen that, in such a design, which is called a "strip matrix" bit, protuberances 52, being formed on the matrix part (i.e. blades) of the bit body could be formed by any of the techniques described above, or variations which might suggest themselves to those of skill in the art, and would then still be part of the bit body in the same sense as in the preceding embodiments. Accordingly, it is intended that the scope of the present invention be defined only by the claims which follow.

What is claimed is:

1. A rotary drill bit for use in drilling holes in subsurface earth formations comprising:

a bit body having a shank at one end for connection to a drill string and an operating end face at the other end;

a plurality of first cutting structures each comprising a preform cutting element mounted in said bit body at said end face, and each having a superhard front cutting face; and a plurality of protuberances projecting outwardly from adjacent portions of said end face, said protuberances forming a plurality of second cutting structures disposed in generally trailing relation, respectively, to at least some of said first cutting structures, each of said protuberances carrying a plurality of superhard particles, various of the particles in each protuberance being disposed at different distances from a surface of revolution defined by the outer extremities of the first cutting structures and each of said protuberances so projecting by a sufficient distance so that it is at least partially aligned with the respective leading first cutting structure;

and wherein at least a major operative portion of each of said second cutting structures is circumferentially separated from the respective leading first cutting structure by an open space.

2. A bit according to claim 1 wherein each of the protuberances has an outer end surface, different portions of which are disposed at different distances from said surface of revolution and which portions carry respective ones of said particles.

3. A bit according to claim 2 wherein said outer end surface has a radius of curvature less than that of the adjacent portion of said surface of revolution.

4. A bit according to claim 3 wherein each of the protuberances is impregnated with such superhard particles through a significant depth measured from the outermost extremity of the protuberance.

5. A bit according to claim 2 wherein said outer end surface is defined by a plurality of sections which approximate an arc, the arc having a radius of curvature less that that of the adjacent portion of said surface of revolution.

6. A bit according to claim 5 wherein each of the protuberances is impregnated with such superhard particles through a significant depth measured from the outermost extremity of the protuberance.

7. A it according to claim 1 wherein each of the protuberances is impregnated with such superhard particles through a significant depth measured from the outermost extremity of the protuberance.

8. A bit according to claim 1 wherein at least a portion of said bit body adjacent said end face and integrally adjoining said protuberances is comprised of a tungsten carbide matrix material.

9. A bit according to claim 8, wherein said protuberances are comprises of a tungsten carbide matrix material monolithically continuous with said matrix portion of said bit body.

10. A bit according to claim 1 wherein said end face of said bit body defines a plurality of upset blades extending generally outwardly from the axis of the bit and interspersed with inset water courses, said cutting structures being dispose don said blades.

11. A bit according to claim 10 wherein, has to each of said second cutting structures, the respective leading fist cutting structure is disposed on the same blade.

12. A bit according to claim 11 wherein at least some of said blades have a row of said second cutting structures therealong at least major operative portions of which are radially separated by open spaces and each directly trailing the respective leading first cutting structure.

13. A bit according to claim 12 wherein at least major operative portions of said first cutting structures on each of said blades are radially separated by open spaces.

14. A bit according to claim 13 wherein the cutting structures on adjacent blades are radially staggered.

15. A bit according to claim 12 wherein each of said blades has an outer surface generally parallel to the profile of the hole to be drilled, at which said cutting structures are disposed, and from which said cutting structures protrude, said second cutting structures protruding therefrom by a distanced less than or equal to that of their respective leading first cutting structures.

16. A bit according to claim 15 wherein any difference in the distance of protrusion of a second cutting structure and its respective leading first cutting structure is less than or equal to one millimeter.

17. A bit according to claim 11 wherein at least some of said second cutting structures are arranged in rows progressing generally radially along said end face of said bit body, the structures in each row being radially separated by open spaces.

18. A bit according to claim 1 wherein said second cutting structures lie on or within said surface of revolution.

19. A bit according to claim 1 wherein any distance between the second cutting structures and said surfacve of revolution is less than or equal to one milimeter.

20. A bit according to claim 1 wherein said superhard particles comprise diamond.

21. A bit according to claim 20 wherein said superhard particles comprise natural diamond.

22. A bit according to claim 20 wherein each of said preform cutting elements comprises a thin facing layer of polycrystalline diamond, defining said cutting face, bonded to a less hard backing layer.

23. A bit according to claim 20 wherein each of said preform cutting elements comprises a layer of thermally stable polycrystalline diamond material.

24. A bit according to claim 1 wherein each of said preform cutting elements comprises a thin facing layer of superhard material, defining said cutting face, bonded to a less hard backing layer.

25. A bit according to claim 1 wherein each of said preform cutting elements comprises a layer of thermally stable polycrystalline diamond material.

26. A bit according to claim 1 wherein each of said protuberances projects from adjacent portions of said end face about its entire circumference.

27. A rotary drill bit for use in drilling holes in subsurface earth formations comprising:

a bit body having a shank at one end for connection to a drill string and an operating end face at the other end;

a plurality of first cutting structures each comprising a preform cutting element mounted in said bit body at said end face, and each having a superhard front cutting face;

said bit body including a plurality of protuberances projecting outwardly from adjacent portions of said end face, said protuberances forming a plurality of second cutting structures disposed in generally trailing relation, respectively, to at least some of said first cutting structures, each of said protuberances comprising a plurality of discrete superhard particles held in a less hard spacer material through a significant depth measured from the outermost extremity of said protuberance;

and wherein at least some of said second cutting structures are arranged in rows progressing generally radially along said end face of said bit body, at least major operative portions of the second cutting structures in each such row being radially separated by open spaces.

28. A bit according to claim 27 wherein said second cutting structures lie on or within a surface of revolution defined by the outer extremities of said first cutting structures.

29. A bit according to claim 28 wherein any distance between the second cutting structures and said surface of revolution is less than or equal to one milimeter.

30. A bit according to claim 27 wherein said superhard particles comprise diamond.

31. A bit according to claim 27 wherein each of said preform cutting elements comprises a thin facing layer of superhard material, defining said cutting face, bonded to a less hard backing layer.

32. A bit according to claim 27 wherein each of said preform cutting elements comprises a unitary layer of thermally stable polycrystalline diamond material.

33. A rotary drill bit for use in drilling holes in subsurface earth formations comprising:

a bit body having a shank at one end for connection to a drill string and an operating end face at the other end;

a plurality of first cutting structures each comprising a preform cutting element mounted in said bit body at said end face, and each having a superhard front cutting face;

said bit body including a plurality of protuberances projecting outwardly forms adjacent portions of said end face, said protuberances form a plurality of second cutting structures disposed in generally trailing relation, respectively, to at least some of said first cutting structures, each of said protuberances comprising a plurality of discrete superhard particles held in a less hard spacer material;

wherein at least some of said first cutting structures are arranged in rows progressing generally radially along said end face of said bit body, at least major operative portions of the first cutting structures in each such row being radially separated by open spaces;

wherein at least some of said second cutting structures are arranged in rows progressing generally radially along said end face of said bit body, at least major operative portions of the second cutting structures in each such row being radially separated by open spaces;

and wherein at least a major operative portion of each of said second cutting structures is circumferentially separated from the respective leading first cutting structure by an open space.

34. A bit according to claim 33 wherein each of said protuberances projects from adjacent portions of said end face about its entire circumference.

* * * * *

UNITED STATES PATENT AND TRADEMARK OFFICE

CERTIFICATE OF CORRECTION

PATENT NO. : 4,991,670

DATED : February 12, 1991

INVENTOR(S) : John Fuller

It is certified that error appears in the above-identified patent and that said Letters Patent is hereby corrected as shown below:

Column 12, line 3, change "it" to --bit--.
Column 12, line 12, change "comprises" to --comprised--.
Column 12, line 19, change "don" to --on--.
Column 12, line 20, change "has" to --as--.
Column 12, line 22, change "fist" to --first--.
Column 12, line 41, change "distanced" to --distance--.
Column 12, line 56, change "surfacve" to --surface--.

In the Abstract, line 19, change "separatred" to --separated--.

Signed and Sealed this

Twenty-first Day of July, 1992

*Attest:*

DOUGLAS B. COMER

*Attesting Officer*

*Acting Commissioner of Patents and Trademarks*